US009677770B2

(12) United States Patent
Lee et al.

(10) Patent No.: US 9,677,770 B2
(45) Date of Patent: Jun. 13, 2017

(54) OVEN

(71) Applicant: Samsung Electronics Co., Ltd., Suwon-si (KR)

(72) Inventors: Dong Ho Lee, Suwon-si (KR); Dong Jin Oh, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 361 days.

(21) Appl. No.: 14/336,336

(22) Filed: Jul. 21, 2014

(65) Prior Publication Data

US 2015/0068510 A1 Mar. 12, 2015

(30) Foreign Application Priority Data

Sep. 11, 2013 (KR) ..... 10-2013-0109189

(51) Int. Cl.
*F24C 15/00* (2006.01)
*F24C 15/04* (2006.01)

(52) U.S. Cl.
CPC ..... *F24C 15/006* (2013.01); *F24C 15/04* (2013.01)

(58) Field of Classification Search
CPC ..... F24C 15/04; F24C 15/006
See application file for complete search history.

(56) References Cited

U.S. PATENT DOCUMENTS

2009/0194090 A1 8/2009 Kim et al.

FOREIGN PATENT DOCUMENTS

| | | |
|---|---|---|
| DE | 198 01 585 A1 | 7/1999 |
| FR | 2 746 903 A1 | 10/1997 |
| KR | 2006-0109157 | 10/2006 |

OTHER PUBLICATIONS

European Search Report dated Mar. 11, 2015 issued in corresponding European Patent Application 14181028.3.

*Primary Examiner* — Alfred Basichas
(74) *Attorney, Agent, or Firm* — Staas & Halsey LLP

(57) ABSTRACT

An oven that effectively cools a door by adjusting a position of a cooling guide includes a casing having at least one inhalation hole and at least one ejection hole; a cooking chamber which has an opening and is placed inside the casing; a door that is rotatably coupled to one portion of the casing so as to open/close the opening; a cooling fan that discharges air introduced into the inhalation hole to the ejection hole placed at a front portion of the casing; and an air guide that is installed adjacent to the ejection hole so as to change a direction of air driven by the cooling fan. The cooling guide is installed not to disturb the flow of air that passes through the door so that the door using minimum sheets of glass can be provided.

22 Claims, 5 Drawing Sheets

OVEN

CROSS-REFERENCE TO RELATED APPLICATIONS

This application claims the priority benefit of Korean Patent Application No. 10-2013-0109189, filed on Sep. 11, 2013 in the Korean Intellectual Property Office, the disclosure of which is incorporated herein by reference.

BACKGROUND

1. Field

Embodiments of the present disclosure relate to an oven, and more particularly, to an oven that effectively cools a door by adjusting a position of a cooling guide.

2. Description of the Related Art

Ovens are apparatuses that seal, heat, and cook a cooking material. Ovens may be generally classified into electric ovens, gas ovens, and electronic ovens, for example, according to heat sources used therein. An electric oven uses an electric heater as a heat source, and each of a gas oven and an electronic oven uses heat caused by gas and frictional heat of water molecules caused by high frequency as a heat source.

When cooking is performed using an oven, temperature inside a cooking chamber rises up to about 300° C. Thus, heat in the cooking chamber is transferred to a door, and the door is heated. Thus, an oven according to the related art includes a door cooling unit for preventing a user from being burnt due to the heated door.

The door cooling unit inhales external air using a cooling fan, ejects the inhaled air to the outside, and generates a flow of air inside the door. This is to use a venturi effect that the speed of air ejected by narrowing the width of a flow path increases and surrounding pressure is dropped. A cooling guide is installed at an ejection hole of air ejected by the cooling fan and narrows the width of the flow path so as to generate the venturi effect.

As the function of the oven is diverse, an oven having a pyrolytic cleaning function of removing foreign substances inside the cooking chamber using high-temperature heat is being distributed. Since the oven uses a higher temperature than a cooking temperature, a plurality of sheets of glass is used to form the door. For example, such a door structure that uses two or more sheets of intermediate glass has problems, such as an increase in the overall weight of the oven, inconveniences of cleaning, and a limitation in the venturi effect.

Also, when the door is open, high-temperature water vapor inside the cooking chamber is discharged upwards, which gives inconveniences to a user.

SUMMARY

Therefore, it is an aspect of the present disclosure to provide an oven in which a cooling guide is installed so as to maximize a venturi effect and to minimize sheets of glass used in a door.

It is another aspect of the present disclosure to provide an oven having an air guide in which, when a door is open, high-temperature vapor ejected to the outside may be diffused downwards.

Additional aspects of the disclosure will be set forth in part in the description which follows and, in part, will be apparent from the description, or may be learned by practice of the disclosure.

In accordance with an aspect of the present disclosure, an oven includes: a casing having at least one inhalation hole; a cooking chamber placed inside the casing and having an opening; a door that is installed to open/close the front opening and forms a flow path of air inside the door using a plurality of sheets of glass including inner glass to seal the cooking chamber; a cooling fan that is installed at an outer portion of the cooking chamber so as to cool the door by inhaling external air through the inhalation hole; a cooling flow path that is installed so that air inhaled by the cooling fan is capable of flowing toward the door in a first direction, so as to generate a flow of air inside the door; door flow paths that are installed so that air inhaled at an end portion of the door is capable of passing through the door and flowing toward the other end portion adjacent to the cooling flow path; and a cooling guide that is installed at the cooling flow path adjacent to the door flow paths and includes a first end portion that extends in the first direction so as to narrow a width of the cooling flow path, wherein the first end portion may be disposed posterior to an inner side surface that forms the door flow paths of the inner glass in the first direction so as to prevent a flow of air that passes through the door flow paths and is directed toward the outside from being disturbed.

The plurality of sheets of glass may include the inner glass, outer glass exposed to the outside, and intermediate glass placed between the inner glass and the outer glass, and the plurality of sheets of glass may be installed to be spaced apart from each other by a predetermined gap and forms the door flow paths.

One sheet of intermediate glass may be installed between the inner glass and the outer glass, and the door flow paths may include a first door flow path formed between the outer glass and the intermediate glass and a second door flow path formed between the intermediate glass and the inner glass.

The cooling fan may be placed at an upper portion of the cooking chamber, and the cooling flow path may extend in the first direction toward the front opening and may include a cooling ejection hole formed an end portion thereof and through which air is ejected toward an upper portion of the door.

The cooling guide may be installed at an end portion of the cooling ejection hole so as to narrow a width of air ejected through the cooling ejection hole and to increase speed of air.

The cooling guide may include a second end portion fixed to a lower portion of the cooling ejection hole, and the first end portion may be installed to be bent upwards.

The cooling guide may be installed to be higher than a top end portion of one among the plurality of sheets of glass.

A top end portion of one among the plurality of sheets of glass and a top end portion of the cooling guide may be installed in the same line.

The first end portion may include a first end surface formed in the first direction, and the first end surface and an inner side surface of the inner glass may be disposed in the same line.

In accordance with another aspect of the present disclosure, an oven includes: a casing that forms an exterior of the oven; a cooking chamber provided inside the casing; a door that is installed to open/close the cooking chamber and includes a plurality of sheets of glass spaced apart from each other by a predetermined gap so as to form a flow path of air; a cooling fan that is installed at an outer side of the cooking chamber inside the casing, inhales external air, and ejects the inhaled air to the outside; a cooling guide that is installed within a flow path of air that is driven by the cooling fan and reduces pressure of the air by narrowing a width of the flow path; a control unit that performs a cleaning mode in which temperature inside the cooking chamber increases and foreign substances are pyrolized and removed; and at least one door flow path formed inside the door using the plurality of sheets of glass, wherein the cooling guide may be installed not to protrude toward an inside of the at least one door flow path.

The door may include one sheet of outer glass, one sheet of intermediate glass, and one sheet of inner glass that are spaced apart from each other by a predetermined gap and are sequentially disposed in a forward/backward direction.

The door may include a first door flow path on which the outer glass and the intermediate glass are formed and a second door flow path on which the intermediate glass and the inner glass are formed, and the cooling guide may be installed anterior to an inner side surface of the inner glass that constitutes the second door flow path in a direction of the cooking chamber.

An end portion of the cooling guide may be placed in the same line as the inner side surface of the inner glass.

A top end portion of the cooling guide may be placed higher than an uppermost end portion of the door so that air passing through the cooling guide is capable of being quickly discharged to the outside.

In accordance with another aspect of the present disclosure, an oven includes: a casing having at least one inhalation hole and at least one ejection hole; a cooking chamber which has an opening, is placed inside the casing and in which food is heated; a door that is rotatably coupled to one side of the casing so as to open/close the front opening; a cooling fan that discharges air introduced into the inhalation hole to the ejection hole placed at a front portion of the casing; and an air guide that is installed adjacent to the ejection hole so as to change a direction of air driven by the cooling fan so that high-temperature vapor from the cooking chamber is capable of being diffused downwards.

The oven may further include a sensor installed to detect opening/closing of the door, and the air guide may be inclined toward a front lower portion of the oven if the door is open, according to a signal of the sensor.

The oven may further include a movement unit that contacts the air guide, and the movement unit may move upwards and downwards according to the signal of the sensor and may cause the air guide to be moved.

The movement unit may include a solenoid valve.

The air guide may be installed to be inclined toward the front lower portion of the oven as the door opens the front opening.

The oven may further include a control unit that controls the number of revolutions of the cooling fan so as to increase speed of ejected air as the door is open.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
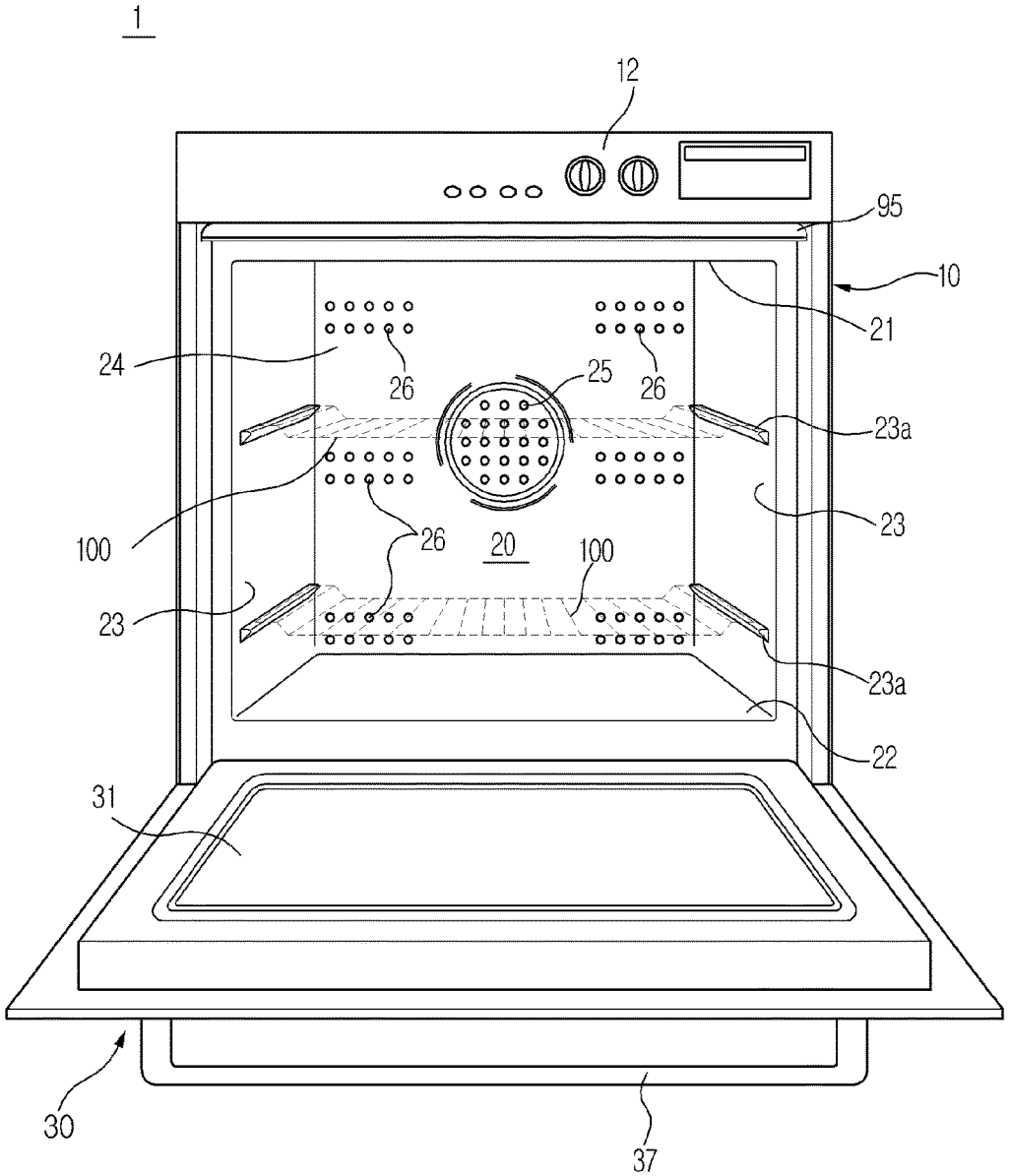
FIG. 1 illustrates an oven in accordance with an embodiment of the present disclosure.

Reference will now be made in detail to embodiments of the present disclosure, examples of which are illustrated in the accompanying drawings, wherein like reference numerals refer to like components throughout.

Figure 2:
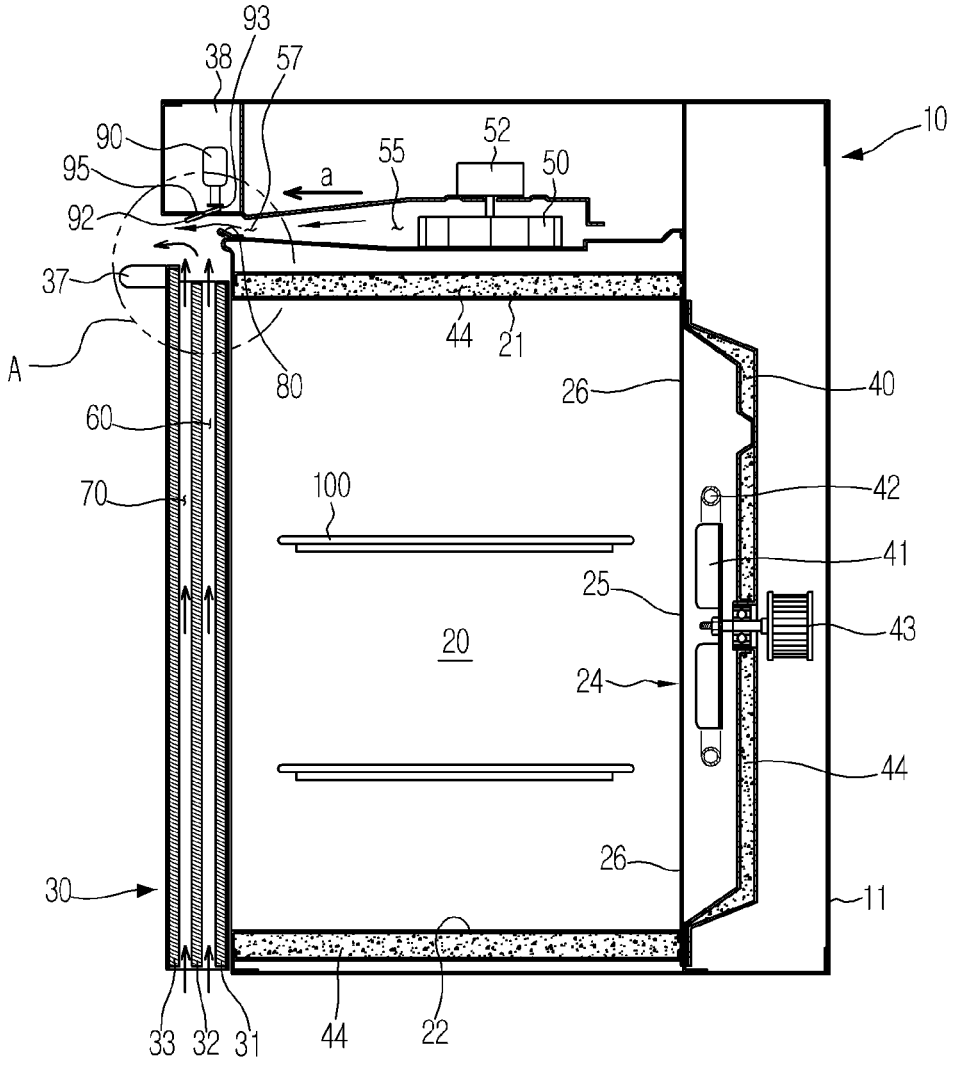
FIG. 2 illustrates a side cross-section of the oven illustrated in FIG. 1.

FIG. 1 illustrates an oven 1 in accordance with an embodiment of the present disclosure, and FIG. 2 illustrates a side cross-section of the oven 1 illustrated in FIG. 1.

The oven 1 may include a casing 10 in which a cooking chamber 20 having an open front portion is disposed and a door 30 that is rotatably coupled to one side portion of the casing 10 so as to open/close the open front portion of the cooking chamber 20.

The cooking chamber 20 includes a cooking space formed thereof by an upper plate 21, a bottom plate 22, side plates 23, and a rear plate 24. Various parts that constitute the oven 1 may be embedded in a space between an outside of the cooking chamber 20 and the casing 10.

A convection fan 41 to which a fan cover 40 is coupled and which causes air to be circulated through the cooking chamber 20, may be embedded at an outer portion of the rear plate 24. At least one electric heater 42 may be installed at the convection fan 41, and a driving motor 43 connected to the convection fan 41 may be installed between the fan cover 40 and a rear plate 24 of the casing 10.

At least one inlet hole 25 may be formed in the vicinity of or around a center portion of the rear plate 24 that faces the convection fan 41 so that air inside the cooking chamber 20 may be introduced through the inlet holes 25. At least one outlet hole 26 may be formed in edge portions of the rear plate 24 so that heat may be supplied into the cooking chamber 20.

In order to insulate the cooking chamber 20 from the outside, insulation members 44 may be disposed at outer sides of the upper plate 21, the bottom plate 22, the both side plates 23, and the fan cover 40 that constitute the cooking chamber 20. A control panel 12 to control an operation of the oven 1 may be installed at a top end portion of the casing 10.

At least one or more racks 100 on which food is to be put, may be disposed inside the cooking chamber 20. Rails 23*a* may be installed on inner side surfaces of the both side plates 23 so that the rack 100 may be mounted on/detached from the inner side surfaces. A user may move the racks 100 along the rails 23*a* and may take out or put food.

The door 30 may be installed to be hinge-coupled to a bottom end portion of the casing 10 so that the user may open/close the cooking chamber 20. A handle 37 may be attached to an upper portion of the door 30 so that the user may rotate the door 30 conveniently.

Food is put on the rack 100 supported on the rails 23*a*, and the door 30 is closed so as to close the cooking chamber 20. Subsequently, the control panel 12 is manipulated to heat the electric heater 42, and the convection fan 41 is rotated by the driving motor 43. Then, air inside the cooking chamber 20 is inhaled into the inlet holes 25, is heated by the electric heater 42, and is supplied to the cooking chamber 20 through the outlet holes 26. Heated air supplied through the outlet holes 26 may be circulated inside the cooking chamber 20 so that food may be cooked.

In this cooking procedure, temperature inside the cooking chamber 20 rapidly increases, and heat of the cooking chamber 20 is transferred to the door 30 placed at the front portion of the cooking chamber 20. Since the door 30 has frequent contact with the user, the door 30 should not be heated by heat of the cooking chamber 20 in order to avoid the user being burned. Thus, the oven 1 may include a cooling fan 50 to cool the door 30.

As illustrated in FIG. 2, the cooling fan 50 is installed at an outer side of the upper plate 21 of the cooking chamber 20, inhales external air, and circulates the inhaled air along a predetermined flow path so as to cool the door 30. The cooling fan 50 may be installed to cause external air to be introduced through at least one opening (an inhalation hole) formed in the rear plate 11 of the casing 10 and to be ejected to the outside.

A cooling motor 52 is coupled to a portion of the cooling fan 50 so as to operate the cooling fan 50.

A cooling flow path 55 may be installed so that air inhaled by the cooling fan 50 may flow toward the front portion of the oven 1. A direction in which air inhaled by the cooling fan 50 flows to the outside, is referred to as a first direction a. The first direction a defines a direction from a rear portion of the oven 1 to the front portion of the oven 1. The cooling flow path 55 may include a cooling ejection hole 57 formed in an end portion adjacent to the door 30 so that inhaled air may be ejected through the cooling ejection hole 57. The cooling ejection hole 57 may be placed at the rear portion of the door 30 in the first direction a so that air that passes through the cooling flow path 55 may be ejected toward the upper portion of the door 30.

A cooling guide 80 may be installed at a dead end portion or end portion of the cooling ejection hole 57 so as to narrow the width of ejected air. The cooling guide 80 may be disposed in the form of a bracket that is bent to narrow the width of the cooling ejection hole 57.

The speed of ejected air increases so that the same amount of air may pass through the cooling ejection hole 57 that is narrowed due to the cooling flow path 55 and the cooling guide 80. A venturi effect that, as the speed of air increases, pressure is reduced and an atmospheric air is inhaled toward a place where air flows, occurs. Thus, pressure of the upper portion of the door 30 from which ejected air is discharged, is lowered, and surrounding air is concentrated on the upper portion of the door 30.

In order to cool the door 30 using force in which the surrounding air is collected on the upper portion of the door 30, at least one of door flow paths 60 and 70 may be disposed inside the door 30. The door flow paths 60 and 70 may be installed so that air inhaled from an end portion of the door 30 may pass through an inner portion of the door 30 and may flow toward the other end portion adjacent to the cooling flow path 55.

In order to form the at least one of door flow paths 60 and 70, the door 30 may include a plurality of sheets of glass 31, 32, and 33 that is spaced apart from each other by a predetermined gap. The plurality of sheets of glass 31, 32, and 33 may include outer glass 33, intermediate glass 32, and inner glass 31, which are disposed at predetermined intervals in a forward/backward direction. The outer glass 33 may be exposed to the outside, and the handle 37 that enables the user to easily rotate the door 30 may be attached to the outer glass 33. The inner glass 31 may be installed to seal the cooking chamber 20 and may be exposed to the outside in a state in which the door 30 is open, as illustrated in FIG. 1. The intermediate glass 32 may be placed between the inner glass 31 and the outer glass 33 and may constitute a plurality of door flow paths 60 and 70. Although as a non-limiting example, only three sheets of glass is shown in FIG. 2, the number of sheets of glass is not limited thereto. For example, two or more sheets of glass may be used.

A sheet of intermediate glass 32 is installed at the oven 1 in accordance with the present disclosure, and the door 30 may include a sheet of outer glass 33, a sheet of intermediate glass 32, and a sheet of inner glass 31. Thus, the door flow paths 60 and 70 may include a first door flow path 70 formed between the outer glass 33 and the intermediate glass 32 and a second door flow path 60 formed between the intermediate glass 32 and the inner glass 31. Although as a non-limiting example, only one sheet of intermediate glass 32 is shown in FIG. 2, however, the number of sheets of glass is not limited thereto. For example, two or more sheets of intermediate glasses may be used and thus, the number of the door flow paths may be increased, or the sheet of intermediate glass may not be used at all.

The door flow paths 60 and 70 may be formed to have a predetermined width, for example, about 5 mm or more at which air may flow. That is, the plurality of sheets of glass 31, 32, and 33 may be installed to be spaced apart from each other by a gap of about 5 mm or more.

In the description of a cooling procedure of the door 30, the door 30 includes the door flow paths 60 and 70 which are coupled to the front portion of the oven 1 and on which air may flow, and the cooling fan 50 disposed at an inner upper portion of the oven 1 inhales external air and ejects external air again. Air circulated by the cooling fan 50 flows from the rear portion to the front portion of the oven 1 along the cooling flow path 55 and is ejected to the upper portion of the door 30 at a high speed due to the cooling guide 80 disposed at the cooling ejection hole 57. External air that is ejected to the upper portion of the door 30 having reduced pressure moves from a bottom end portion of the door 30 to a top end portion of the door 30 through the door flow paths 60 and 70 so that the door 30 may be cooled.

A control unit 38 may be placed at the upper portion of the oven 1 and may be spaced apart from the door 30 by a gap which has a predetermined length, at which air passing through the cooling flow path 55 and the door flow paths 60 and 70 may be discharged toward a front portion of the control panel 12. That is, the control unit 38 may be placed at a rear portion of the control panel 12 exposed to the outside. The control unit 38 may perform a cleaning mode in which temperature inside the cooking chamber 20 increases and foreign substances are pyrolyzed and removed.

When it is difficult to perform cleaning due to oil, grease or fat that comes from food heated and cooked in the cooking chamber 20, that is attached to internal wall surfaces of the cooking chamber 20, and that is solidly hardened, a pyrolytic cleaning function may be used. Pyrolytic cleaning is a procedure in which temperature inside the cooking chamber 20 is kept at a high temperature for a long time using the electric heater 42 to burn and remove contaminants. Since a temperature higher than cooking temperature is required to perform pyrolytic cleaning, two or more sheets of intermediate glass may be used to prevent the door 30 from being heated.

However, although a plurality of sheets of intermediate glass may be used, if two or more sheets of intermediate glass are used, the weight of the door 30 may increase, and it may be difficult to decompose and clean glass when less than two sheets of intermediate glass is used. Therefore, the oven 1 in accordance with the present includes the pyrolytic cleaning function so that cooling efficiency of the door 30 may increase even though only one sheet of intermediate glass 32 is used. The position of the cooling guide 80 installed for efficient cooling of the door 30 by maximizing the venturi effect will be described below.

Figure 3:
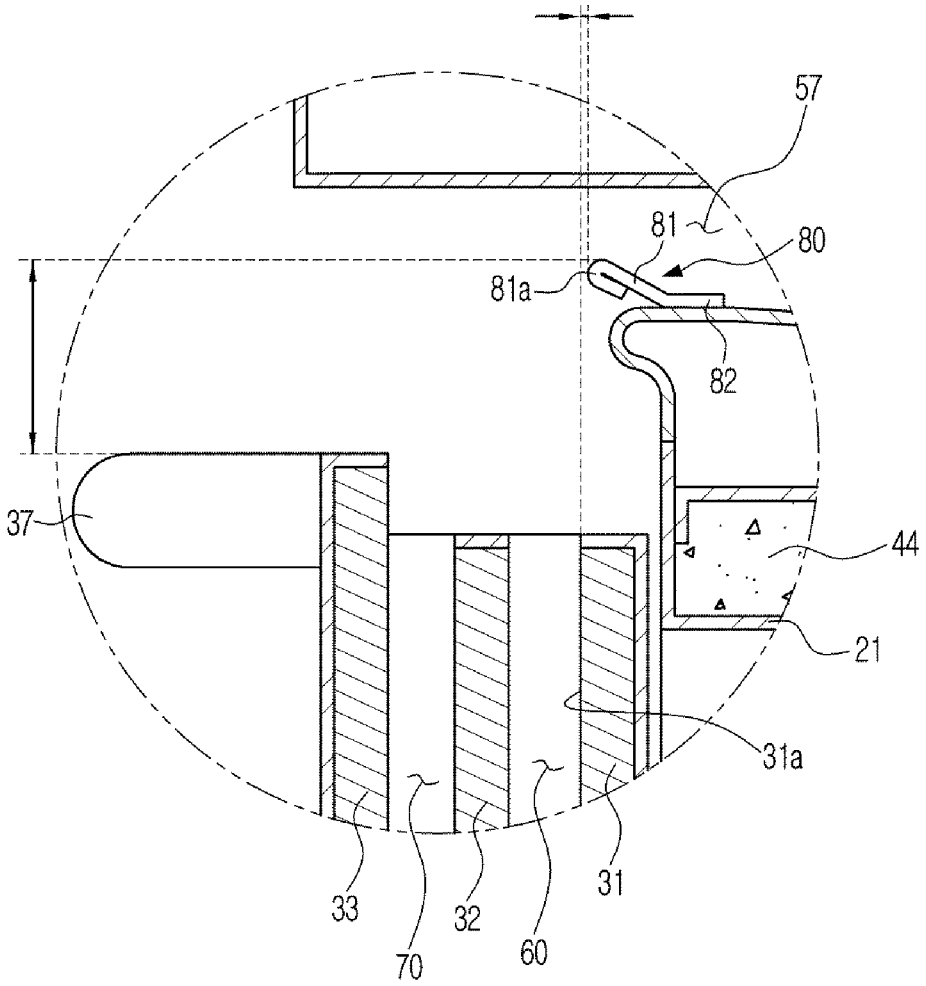
FIG. 3 is an enlarged view taken along portion A of FIG. 2.
Figure 4:
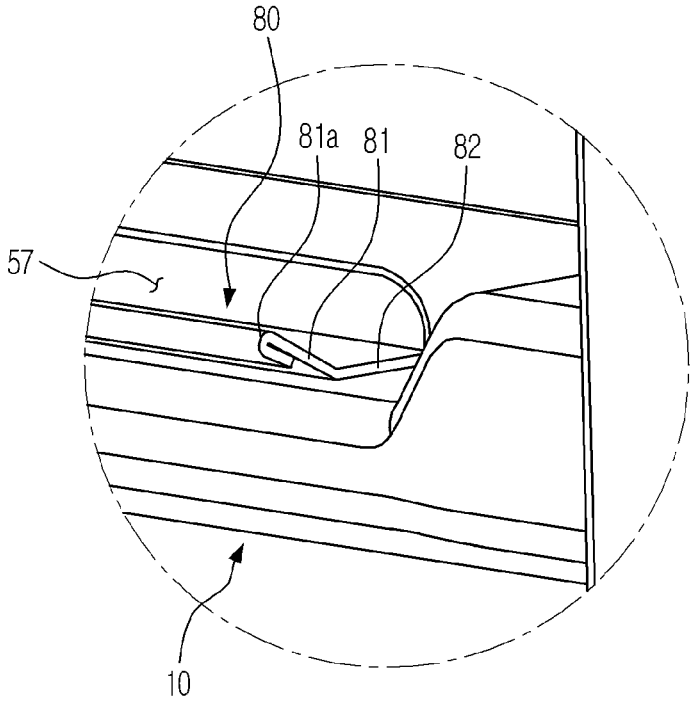
FIG. 4 illustrates a cooling guide of the oven of FIG. 1.

FIG. 3 is an enlarged view taken along portion A of FIG. 2, and FIG. 4 illustrates the cooling guide 80 of the oven 1 of FIG. 1. In order to describe the cooling guide 80, an air guide 95 and a movement unit 90 that will be described in FIG. 5 below are omitted.

The cooling guide 80 may be installed at a dead end portion or end portion of the cooling ejection hole 57 so as to increase the speed of air flow by narrowing the width of air ejected through the cooling ejection hole 57. The cooling guide 80 may include a first end portion 81 that extends in the form of a bent bracket in the first direction a and a second end portion 82 that is placed at an opposite side to a side in which the first end portion 81 is placed. The second end portion 82 may be fixed to a lower portion of the cooling ejection hole 57, and the first end portion 81 may be formed to be bent upwards.

As illustrated in FIG. 4 which illustrates an open state of the door 30, the cooling guide 80 also extends long in a lengthwise direction along the lower portion of the cooling ejection hole 57 that extends long in a lengthwise direction and is fixed to the lower portion of the cooling ejection hole 57. The casing 10 that constitutes the cooling guide 80 and the cooling ejection hole 57 may be separately manufactured and may be coupled to the door 30 via a connection member, such as a screw. In a state in which the door 30 is closed, the cooling guide 80 may not be exposed to the outside due to the upper portion of the door 30.

The first end portion 81 includes a first end surface 81*a* formed in the first direction a of the first end portion 81. That is, the first end surface 81*a* defines a place that extends from the cooling guide 80 in the first direction a farthest. In order to maximize the venturi effect, the cooling guide 80 may be installed not to protrude toward insides of the door flow paths 60 and 70.

That is, in order to prevent the flow of air that passes through the door flow paths 60 and 70 and that is directed toward the outside from being disturbed, the first end surface 81*a* is disposed posterior to an inner side surface 31*a* that constitutes the second door flow path 60 of the inner glass 31 in the first direction a. In other words, the cooling guide 80 may be installed anterior to the inner side surface 31*a* of the inner glass 31 that constitutes the second door flow path 60 in a direction of the cooking chamber 20.

Since the cooling guide 80 is not placed at upper portions of the door flow paths 60 and 70, air that passes through the door flow paths 60 and 70 may be discharged to the outside together with air that passes through the cooling flow path 55 without getting interrupted by the cooling guide. Since air is quickly discharged toward the upper portions of the door flow paths 60 and 70, air may be more quickly inhaled from lower portions of the door flow paths 60 and 70. Thus, the amount of air per hour that passes through the door flow paths 60 and 70 increases so that the door 30 may be effectively cooled.

Further, a certain end portion of the cooling guide 80 may be placed in the same line as the inner side surface 31*a* of the inner glass 31. That is, the first end surface 81*a* and the inner side surface 31*a* of the inner glass 31 may be disposed in the same line. Thus, the flow of air discharged through the door flow paths 60 and 70 is not disturbed, and simultaneously, air that passes through the cooling flow path 55 is ejected from the upper portions of the door flow paths 60 and 70 at the highest speed so that the venturi effect may be maximized.

Further, when air ejected through the cooling ejection hole 57 is discharged to the outside without being interrupted, the venturi effect may be maximized. Thus, the cooling guide 80 that determines the height of ejected air needs to be higher than the door 30.

The cooling guide 80 may be installed at an upper portion than a top end portion of one among the plurality of sheets of glass 31, 32, and 33. That is, a top end portion of the cooling guide 80 may be placed higher than the uppermost end portion of the door 30 so that air passing through the cooling guide 80 may be quickly discharged to the outside. In FIG. 3, a top end portion 33*a* of the outer glass 33 is the uppermost end portion and thus, the cooling guide 80 is installed to be higher than the top end portion 33*a* of the outer glass 33.

Also, a top end portion of one among the plurality of sheets of glass 31, 32, and 33 and a top end portion of the cooling guide 80 may be installed in the same line. Since, due to the structure of the oven 1, the width of a path on which air may be ejected, is limited, the position of the cooling guide 80 may be limited. In this case, the cooling guide 80 needs to be installed at least at the same height as the top end portion of sheet of glass.

Thus, if the cooling guide 80 is placed posterior to the door flow paths 60 and 70 and is placed at an upper portion than the top end portion of the door 30, the venturi effect may be maximized. This may include the case that the inner side surface 31*a* of the inner glass 31 that constitute the door flow paths 60 and 70 and one end portion of the cooling guide 80 are placed in the same line or the case that the uppermost end portion of the door 30 and the upper portion of the cooling guide 80 are placed in the same line.

Figure 5:
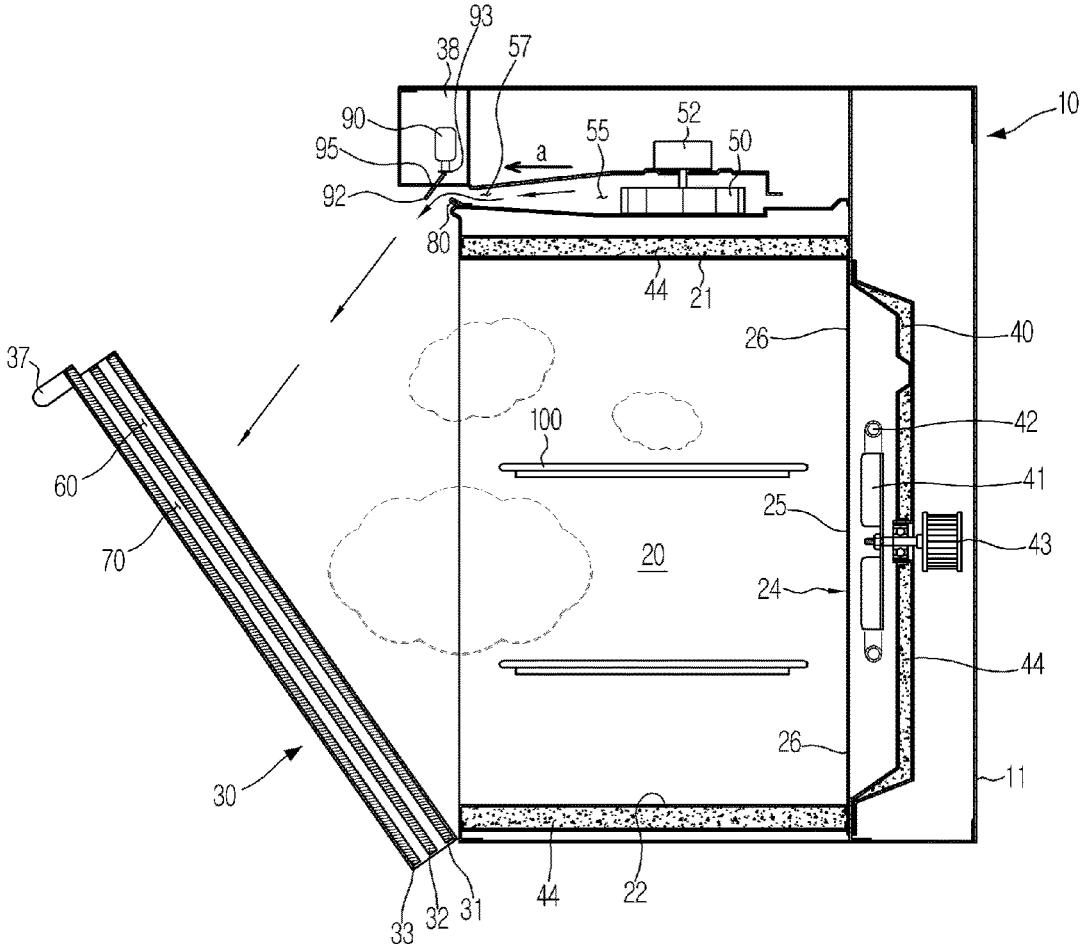
FIG. 5 illustrates a state in which a door of the oven in FIG. 2 is open.

FIG. 5 illustrates a state in which the door 30 of the oven 1 in FIG. 2 is open.

As described above, the control unit 38 may be placed above the door 30 and may be spaced apart from the door 30 by a gap which has a predetermined length, at which air passing through the cooling flow path 55 and the door flow paths 60 and 70 is discharged toward a front portion of the oven 1. The air guide 95 may be placed at a lower portion of the control unit 38 so as to change the direction of ejected air.

The air guide 95 may be flat-shaped, for example, may be disposed in the form of a flat bracket that passes through the lower portion of the control unit 38. The air guide 95 may include a first end portion 92 placed at a lower portion of a bottom surface of the control unit 38 and a second end portion 93 placed at an upper portion of the bottom surface of the control unit 38. Also, when a center of gravity of the air guide 95 is placed at the first end portion 92 and no external force is applied to the air guide 95, the air guide 95 may be placed perpendicular to the bottom surface of the control unit 38 so that the first end portion 92 may be placed at the lower portion of the bottom surface of the control unit 38 and the second end portion 93 may be placed at the upper portion of the bottom surface of the control unit 38.

The second end portion 93 may contact the movement unit 90 that is placed inside the control unit 38. A rotational center of the air guide 95 is placed adjacent to the bottom surface of the control unit 38, and the movement unit 90 moves upwards and downwards and applies external force to the second end portion 93, so that the air guide 95 may be rotated. The movement unit 90 may be disposed as, for example, a solenoid valve and may move upwards and downwards due to an electric signal. Alternatively, the air guide 95 may be configured to be installed at a front portion of the door 30 in which ejected air is discharged without an additional movement unit and to descend as the door 30 is open.

When the movement unit 90 moves upwards, the air guide 95 is rotated so that the first end portion 92 may be placed downwards and the second end portion 93 may be placed upwards due to the center of gravity of the air guide 95. That is, the air guide 95 may be inclined toward the front upper portion of the oven 1. As a result, ejected air may be discharged to the outside while the direction of the ejected air is changed into the front upper portion of the oven 1 along the air guide 95.

When the movement unit 90 moves downwards and applies external force to the second end portion 93, the air guide 95 is rotated in a direction in which the first end portion 92 and the second end portion 93 may be horizontally placed or close to being flat. As a result, the flow of ejected air may not be disturbed, and air that passes through the cooling flow path 55 and the door flow paths 60 and 70 may be discharged to the outside smoothly.

The oven 1 may further include a sensor that is installed to detect opening/closing the door 30. The sensor may be installed at the door 30 or the casing 10 that contacts the door 30. The movement unit 90 moves according to a signal of the sensor, and when the door 30 is open, the air guide may be inclined toward a front lower portion of the oven 1.

This is to prevent the user from being injured due to high-temperature vapor inside the cooking chamber 20 that is discharged to the outside when the door 30 is open and light-weight and high-temperature vapor that is diffused upwards. In order to diffuse high-temperature vapor from the cooking chamber 20 downwards, ejected air may be driven or guided to the front lower portion of the oven 1 along the air guide 95 inclined to the front lower portion of the oven 1.

The control unit 38 may control the number of revolutions of the cooling fan 50 so as to increase the speed of ejected air as the door 30 is open. As the cooling fan 50 is quickly rotated and the ejected air is strongly driven or guided to the front lower portion of the oven 1, high-temperature vapor from the cooking chamber 20 may be effectively diffused downwards.

As described above, a cooling guide is installed not to disturb the flow of air that flows through a door so that, as a venturi effect is maximized, a door using minimum sheets of glass may be provided.

Also, the flow of air is changed through an air guide so that high-temperature vapor that are discharged upwards may be diffused downwards and a user may be protected.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An oven comprising:

a casing having at least one inhalation hole through which air outside is introduced to and an ejection hole through which air inside of the oven is discharged to outside;

a cooking chamber placed inside the casing and having an opening;

a door that is installed to open/close the opening and forms a flow path of air inside the door using a plurality of sheets of glass including inner glass to seal the cooking chamber;

a cooling fan that is installed at an outer portion of the cooking chamber so as to cool the door by inhaling external air through the inhalation hole;

a cooling flow path that is installed so that air inhaled by the cooling fan is capable of flowing toward the door in a first direction, so as to generate a flow of air inside the door;

door flow paths that are installed so that air inhaled at an end portion of the door is capable of passing through the door and flowing toward the other end portion adjacent to the cooling flow path; and a cooling guide that is installed at the cooling flow path adjacent to the door flow paths and comprises a first end portion that extends in the first direction so as to narrow a width of the cooling flow path;

an air guide that is installed adjacent to the ejection hole so as to change a direction of air driven by the cooling fan so that high-temperature vapor from the cooking chamber is capable of being diffused downwards; and a movement unit that contacts the air guide and moves upwards and downwards based on the received signal and adjust the air guide, wherein the first end portion is disposed posterior to an inner side surface that forms the door flow paths of the inner glass in the first direction so as to prevent a flow of air that passes through the door flow paths and is directed toward the outside from being disturbed.

2. The oven of claim 1, wherein the plurality of sheets of glass comprise the inner glass, outer glass exposed to the outside, and intermediate glass placed between the inner glass and the outer glass, and the plurality of sheets of glass are installed to be spaced apart from each other by a predetermined gap and forms the door flow paths.

3. The oven of claim 2, wherein one sheet of intermediate glass is installed between the inner glass and the outer glass, and the door flow paths comprise a first door flow path formed between the outer glass and the intermediate glass and a second door flow path formed between the intermediate glass and the inner glass.

4. The oven of claim 1, wherein the cooling fan is placed at an upper portion of the cooking chamber, and the cooling flow path extends in the first direction toward the opening, and comprises a cooling ejection hole formed an end portion thereof and through which air is ejected toward an upper portion of the door.

5. The oven of claim 4, wherein the cooling guide is installed at an end portion of the cooling ejection hole so as to narrow a width of air ejected through the cooling ejection hole and to increase speed of air.

6. The oven of claim 5, wherein the cooling guide comprises a second end portion fixed to a lower portion of the cooling ejection hole, and the first end portion is installed to be bent upwards.

7. The oven of claim 1, wherein the cooling guide is installed to be higher than a top end portion of one among the plurality of sheets of glass.

8. The oven of claim 1, wherein a top end portion of one among the plurality of sheets of glass and a top end portion of the cooling guide are installed in the same line.

9. The oven of claim 1, wherein the first end portion comprises a first end surface formed in the first direction, and the first end surface and an inner side surface of the inner glass are disposed in the same line.

10. An oven comprising:

a casing that forms an exterior of the oven;

a cooking chamber provided inside the casing;

a door that is installed to open/close the cooking chamber and comprises a plurality of sheets of glass spaced apart from each other by a predetermined gap so as to form a flow path of air;

a cooling fan that is installed at an outer portion of the cooking chamber, inhales external air, and ejects the inhaled air to the outside;

a cooling guide that is installed within a flow path of air that is driven by the cooling fan and reduces pressure of the air by narrowing a width of the flow path;

a control unit that performs a cleaning mode in which temperature inside the cooking chamber increases and foreign substances are pyrolized and removed and controls the cooling fan to increase speed of the elected air when the door is open; and at least one door flow path formed inside the door using the plurality of sheets of glass, wherein the cooling guide is installed not to protrude toward an inside of the at least one door flow path.

11. The oven of claim 10, wherein the plurality of sheets of glass comprises a sheet of outer glass, a sheet of intermediate glass, and a sheet of inner glass that are spaced apart from each other by a predetermined gap.

12. The oven of claim 11, wherein the door comprises a first door flow path on which the outer glass and the intermediate glass are formed and a second door flow path on which the intermediate glass and the inner glass are formed, and the cooling guide is installed anterior to an inner side surface of the inner glass that forms the second door flow path in a direction of the cooking chamber.

13. The oven of claim 11, wherein an end portion of the cooling guide is placed in the same line as the inner side surface of the inner glass.

14. The oven of claim 10, wherein a top end portion of the cooling guide is placed higher than an uppermost end portion of the door so that air passing through the cooling guide is capable of being quickly discharged to the outside.

15. An oven comprising:

a casing having at least one inhalation hole and at least one ejection hole;

a cooking chamber which has an opening and is placed inside the casing;

a door that is rotatably coupled to one portion of the casing so as to open/close the opening;

a cooling fan that discharges air introduced into the inhalation hole to the ejection hole placed at a front portion of the casing;

an air guide that is installed adjacent to the ejection hole so as to change a direction of air driven by the cooling fan; and a sensor installed to detect opening and closing of the door, wherein the air guide is adjusted based on a signal received from the sensor.

16. The oven of claim 15, further comprising a movement unit that contacts the air guide, wherein the movement unit moves upwards and downwards based on the received signal and adjust the air guide.

17. The oven of claim 16, wherein the movement unit comprises a solenoid valve.

18. The oven of claim 15, wherein the air guide is installed to be inclined toward the front lower portion of the oven as the door opens the front opening.

19. The oven of claim 15, further comprising a control unit that controls the cooling fan to increase speed of ejected air when the door is open.

20. An oven comprising:

a casing having at least one inhalation hole and at least one exit hole;

a cooking chamber which has an opening and is placed inside the casing;

a door coupled to the casing to open/close the opening door, the door including at least one door flow path that is formed an inner portion of the door so that air inhaled at one end portion of the door flows toward the other end portion;

a cooling fan that discharges air introduced into the inhalation hole to the exit hole through a cooling flow path that is formed in an inner upper portion of the oven; and a cooling guide that is provided at the cooling flow path adjacent to the door flow paths and narrow a width of the cooling flow path to increase speed of the air flow therethrough;

an air guide that is installed adjacent to the exit hole so as to change a direction of air driven by the cooling fan so that high-temperature vapor from the cooking chamber is capable of being diffused downwards; and a movement unit that contacts the air guide and moves upwards and downwards based on the received signal and adjust the air guide.

21. The oven of claim 20, wherein the door comprises a plurality of sheets of glass spaced apart from each other by a predetermined distance to form a flow path of air in order to cool the door.

22. The oven of claim 20, further comprising an air guide that is installed adjacent to the exit hole to adjust a direction of air driven by the cooling fan.

* * * * *